US008382556B2

(12) United States Patent
Yamashiro et al.

(10) Patent No.: US 8,382,556 B2
(45) Date of Patent: Feb. 26, 2013

(54) PORTABLE BELT GRINDER

(75) Inventors: Naoto Yamashiro, Ibaraki (JP); Akira Onose, Ibaraki (JP); Shinichi Sakuma, Ibaraki (JP)

(73) Assignee: Hitachi Koki Co., Ltd., Tokyo (JP)

( * ) Notice: Subject to any disclaimer, the term of this patent is extended or adjusted under 35 U.S.C. 154(b) by 902 days.

(21) Appl. No.: 12/445,296

(22) PCT Filed: Oct. 12, 2007

(86) PCT No.: PCT/JP2007/070398

§ 371 (c)(1),
(2), (4) Date: Jul. 8, 2009

(87) PCT Pub. No.: WO2008/047890

PCT Pub. Date: Apr. 24, 2008

(65) Prior Publication Data

US 2010/0003905 A1 Jan. 7, 2010

(30) Foreign Application Priority Data

Oct. 13, 2006 (JP) ..... P2006-279594
Dec. 19, 2006 (JP) ..... P2006-340687

(51) Int. Cl.
*B24B 23/00* (2006.01)

(52) U.S. Cl. ..... 451/355; 451/297

(58) Field of Classification Search ..... 451/6, 59, 451/296, 297, 350, 355
See application file for complete search history.

(56) References Cited

U.S. PATENT DOCUMENTS 2,282,658 A * 5/1942 Kneisley ..... 451/355
3,049,842 A 8/1962 Murschel
(Continued)

FOREIGN PATENT DOCUMENTS

CN 1307953 A 8/2001
DE 299 22 880 U1 5/2001
(Continued)

OTHER PUBLICATIONS

Office Action from the Russian Patent Office, Mar. 22, 2011.
(Continued)

*Primary Examiner* — Eileen P. Morgan
(74) *Attorney, Agent, or Firm* — Kenealy Vaidya LLP

(57) ABSTRACT

The portable belt grinder 201 comprises; a main body 202 with an electric motor 203 built therein; a drive pulley disposed in the lower portion of the main body 202 and rotationally drivable by the electric motor 203; an idle pulley disposed as the companion to the drive pulley; and, an endless abrasive belt 215 wound between the two pulleys. In the portable belt grinder 201, in the portion of the main body 202 that exists in the vicinity of the abrasive belt 215, there is formed a hole portion **202*f* which is used to visually confirm the side end edge of the abrasive belt 215 from above. Also, on the upper surface of the main body 202, there is mounted a transparent cover 222 which is used to cover the hole portion 202*f***.

4 Claims, 10 Drawing Sheets

U.S. PATENT DOCUMENTS

| | | | | |
|---|---|---|---|---|
| 3,535,829 | A | 10/1970 | Dudek | |
| 4,642,943 | A | 2/1987 | Taylor, Jr. | |
| 6,908,374 | B2 * | 6/2005 | Wang et al. | 451/296 |
| 2001/0036802 | A1 * | 11/2001 | Mueller | 451/355 |
| 2002/0173225 | A1 * | 11/2002 | Wang et al. | 451/5 |
| 2003/0153245 | A1 * | 8/2003 | Talieh et al. | 451/8 |
| 2010/0203464 | A1 * | 8/2010 | Nevin | 433/29 |

FOREIGN PATENT DOCUMENTS

| | | | |
|---|---|---|---|
| EP | 1 647 362 | A1 | 4/2006 |
| GB | 838 887 | A | 6/1960 |
| JP | 57-86783 | U | 5/1982 |
| JP | 2000-280157 | A | 10/2000 |
| SU | 831570 | | 5/1981 |

OTHER PUBLICATIONS

First Office Action from the State Intellectual Property Office of P.R.C., Mar. 11, 2010.

Japanese Office Action for related Japanese Patent Application No. 2006-340687 dated Oct. 4, 2011.

Office Action of the IPO (Taiwan), Sep. 16, 2010.

* cited by examiner

PORTABLE BELT GRINDER

TECHNICAL FIELD

The present invention relates to a portable belt grinder which rotates an endless abrasive belt wound between a drive pulley and an idle pulley to grind the abrasive belt.

BACKGROUND ART

Now, description will be given below of a conventional portable belt grinder with reference to FIGS. 13 and 14.

FIG. 13 is a right side view of a conventional portable belt grinder, and FIG. 14 is a plan view of the conventional portable belt grinder. A portable belt grinder 101 shown in these figures includes, in the rear lower portion of a main body 102 thereof, a drum-shaped drive pulley 106 which can be driven and rotated by an electric motor (not shown).

Also, an idle pulley 113 is rotatably disposed in the front lower portion of the main body 102 and, between the idle pulley 113 and drive pulley 106, there is wound an endless abrasive belt 115. As the drive pulley 106 is driven and rotated by the electric motor, the abrasive belt 115 is rotated in the direction of the arrow mark shown in FIG. 13. Here, between the drive pulley 106 and idle pulley 113, there is interposed a guide plate 116; and, the abrasive belt 115 is rotated on the lower surface of the guide plate 116. When the abrasive belt 115 is pressed against a member to be ground W, the surface of the member to be ground W can be ground by the abrasive belt 115.

And, the main body 102 includes, in one side surface thereof existing closer to the abrasive belt 115, an open portion 102*e* which can be used to replace the abrasive belt 115.

Also, the upper surface of the abrasive belt 115 is almost covered with the main body 102. And, the main body 102 includes, in a portion of the front end thereof, an exposure portion 102*d* in order to use the curved surface of the idle pulley 113 for grinding.

When carrying out a grinding operation using the present portable belt grinder 101, an operator may be generally situated in the rear of the main body 102 because the operator grips not only a main handle 102*a* disposed in the rear portion of the main body 102 but also a sub handle 102*b* disposed in the front portion of the main body 102.

FIG. 15 is a section view taken along the E-E line shown in FIG. 13. A portable belt grinder 101 shown in FIG. 13 includes, in the rear lower portion of a main body 102 thereof, a drum-shaped drive pulley 106 which can be driven and rotated by an electric motor (not shown).

Also, an idle pulley 113 is rotatably disposed in the front lower portion of the main body 102 and, between the idle pulley 113 and drive pulley 106, there is wound an endless abrasive belt 115. As the drive pulley 106 is driven and rotated by the electric motor in the direction of the arrow mark shown in FIG. 13 (in the clockwise direction), the abrasive belt 115 is rotated in the same direction (in the arrow mark direction). Here, between the drive pulley 106 and idle pulley 113, there is interposed a guide plate 116; and, the abrasive belt 115 is rotated on the lower surface of the guide plate 116. When the abrasive belt 115 is pressed against a member to be ground W, the surface of the member to be ground W can be ground by the abrasive belt 115.

And, the main body 102 includes, in one side surface thereof existing closer to the abrasive belt 115, an open portion 102*e* which can be used to replace the abrasive belt 115. Also, as shown in FIG. 15, on the inner wall 102*j* of the main body 102 situated on the opposite side to the open side thereof, there are integrally provided two rib-shaped projections 102*k* in such a manner that they are spaced from each other in the longitudinal direction of the main body 102 (in the moving direction of the abrasive belt 115); and on these two projections 102*k*, there is mounted a rectangular plate-shaped belt guide 125 by a screw (see FIG. 13) in such a manner that they are substantially parallel to the one side end edge of the abrasive belt 115. This guide belt 125 is made of a material (such as an iron plate) higher in hardness than the main body 102 and, when the abrasive belt 115 is moved laterally as shown by a dot and dash line in FIG. 15, the guide belt 125 receives the one side end edge of the abrasive belt 115 to regulates the lateral movement (shift) of the abrasive belt 115.

However, in the conventional portable belt grinder 101 shown in FIGS. 22 and 23, as described above, since the upper surface of the abrasive belt 115 is almost covered with the main body 102, in the grinding operation, in order to confirm the position of the abrasive belt 115, the operator must look into the open portion 102*e* formed in the side surface of the main body 102 or the exposure portion 102*d* formed in the front end portion of the main body 102. This means that it is difficult for the operator to confirm which position of the member to be ground W is currently being ground.

Also, the abrasive belt 115 can be moved laterally depending on the contents of the grinding operation during the grinding operation. Although the lateral movement of the abrasive belt 115 is restricted by the belt guide, the two end faces of the abrasive belt 115 in the longitudinal direction thereof respectively have a right-angled surface. Owing to this, when the abrasive belt 115 moves laterally as shown by a chain line in FIG. 12 and the side end edge thereof touches the belt guide, the abrasive belt 115 collides with the right-angled corner portions of the two end faces of the belt guide in the longitudinal direction thereof, the abrasive belt 115 can be broken. And, in the conventional portable belt grinder 101, there is also found another problem that, since the belt end portion is difficult to observe, the grinding operation is continued on without noticing the touch of the abrasive belt 115 with the belt guide, thereby lowering the life of the abrasive belt 115 greatly.

DISCLOSURE OF INVENTION

The present invention aims at solving the above problems. Thus, it is an object of the invention to provide a portable belt grinder which makes it possible to visually confirm the belt end portion easily and thus can not only enhance the efficiency of the grinding operation but also extend the life of the abrasive belt.

In attaining the above object, according to the invention as set forth in Claim 1, there is provided a portable belt grinder, comprising: a main body with an electric motor built therein; a drive pulley disposed in the lower portion of the main body and rotationally drivable by the electric motor; an idle pulley disposed as the companion to the drive pulley; and, an endless abrasive belt wound between the two pulleys, wherein, in the portion of the main body that exists in the vicinity of the abrasive belt, there is formed a hole portion for visually confirming the side end edge of the abrasive belt from above.

According to the invention as set forth in Claim 2, in the invention as set forth in Claim 2, a portion of one side surface of the main body existing closer to the abrasive belt is formed open, and the above-mentioned hole portion is formed in the portion of the main body existing on the opposite side to the above-mentioned open portion.

According to the invention as set forth in Claim 3, in the invention as set forth in Claim 1 or 2, on the upper surface of the main body, there is mounted a transparent cover for covering the hole portion.

According to the invention as set forth in Claim 4, in the invention as set forth in Claim 3, the inner wall of the transparent cover is disposed more distant from the abrasive belt than the inner wall of the main body and, on the portion of the inner wall of the main body that exists in the vicinity of the hole portion and on the opposite side of the rotation direction of the abrasive belt, there is provided a projection portion extending almost at right angles to the abrasive belt.

According to the invention as set forth in Claim 5, in the invention as set forth in Claim 3, there is further included an air passage for blowing electric motor cooling air by a cooling fan onto the upper surface portion of the transparent cover.

According to the invention as set forth in Claim 6, in the invention as set forth in any one of Claims 1 to 4, on the inner wall of the main body, there is mounted a belt guide for restricting the lateral movement of the abrasive belt, and the two belt moving direction end portions of the belt guide are respectively curved in an R shape toward the inner wall of the main body.

According to the invention as set forth in Claims 1 and 2, in the portion of the main body that exists in the vicinity of the abrasive belt, there is formed a hole portion for visually confirming the side end edge of the abrasive belt from above. Owing to this, in the grinding operation, without looking into the open portion of the main body side surface or the exposure portion of the main body front end, the operator can easily confirm which position of the member to be ground is currently being ground, thereby being able to enhance the efficiency of the grinding operation.

Also, since the end portion of the abrasive belt and the inner wall portion of the main body extending parallel to the abrasive belt end portion can be visually confirmed from the hole portion, the touch between the abrasive belt and main body inner wall portion or belt guide can be confirmed. Therefore, by advancing the grinding operation while preventing these two elements from touching each other, the durability of the abrasive belt can be enhanced and thus the life thereof can be extended.

According to the invention as set forth in Claim 3, since the hole portion is covered with the transparent cover, in the grinding operation, the hands of the operator can be prevented from touching the abrasive belt, thereby ensuring the safety of the operator.

According to the invention as set forth in Claim 4, the inner wall of the transparent cover is disposed more distant from the abrasive belt than the inner wall of the main body and, on the portion of the inner wall of the main body that exists in the vicinity of the hole portion and on the opposite side of the rotation direction of the abrasive belt, there is provided a projection portion extending almost at right angles to the abrasive belt. Owing to this, cut powder, which is produced due to the grinding of the member to be ground and flies around along the abrasive belt, is allowed to collide with the projection portion. This can prevent the cut powder from sticking to the inner wall of the transparent cover and thus can prevent the lowered visual confirmation performance due to the sticking of the cut powder.

According to the invention as set forth in Claim 5, since there is formed an air passage for blowing cooling air, which is used to cool the electric motor by a cooling fan, onto the upper surface portion of the transparent cover, in the grinding operation, the cut powder flown up to the outside of the main body can be prevented from sticking to the upper surface portion of the transparent cover, which can prevent the lowered visual confirmation performance due to the sticking of the cut powder to the transparent cover.

According to the invention as set forth in Claim 6, since the two end portions of the belt guide in the belt moving direction are respectively curved in an R shape toward the main body inner wall, even when the abrasive belt moves laterally and the side end edge thereof touches the belt guide, the collision of the abrasive belt with the two end portions of the belt guide in the longitudinal direction thereof can be avoided, which can prevent the abrasive belt from being broken due to such possible collision.

BEST MODE FOR CARRYING OUT THE INVENTION

<Embodiment 1>

Figure 1:
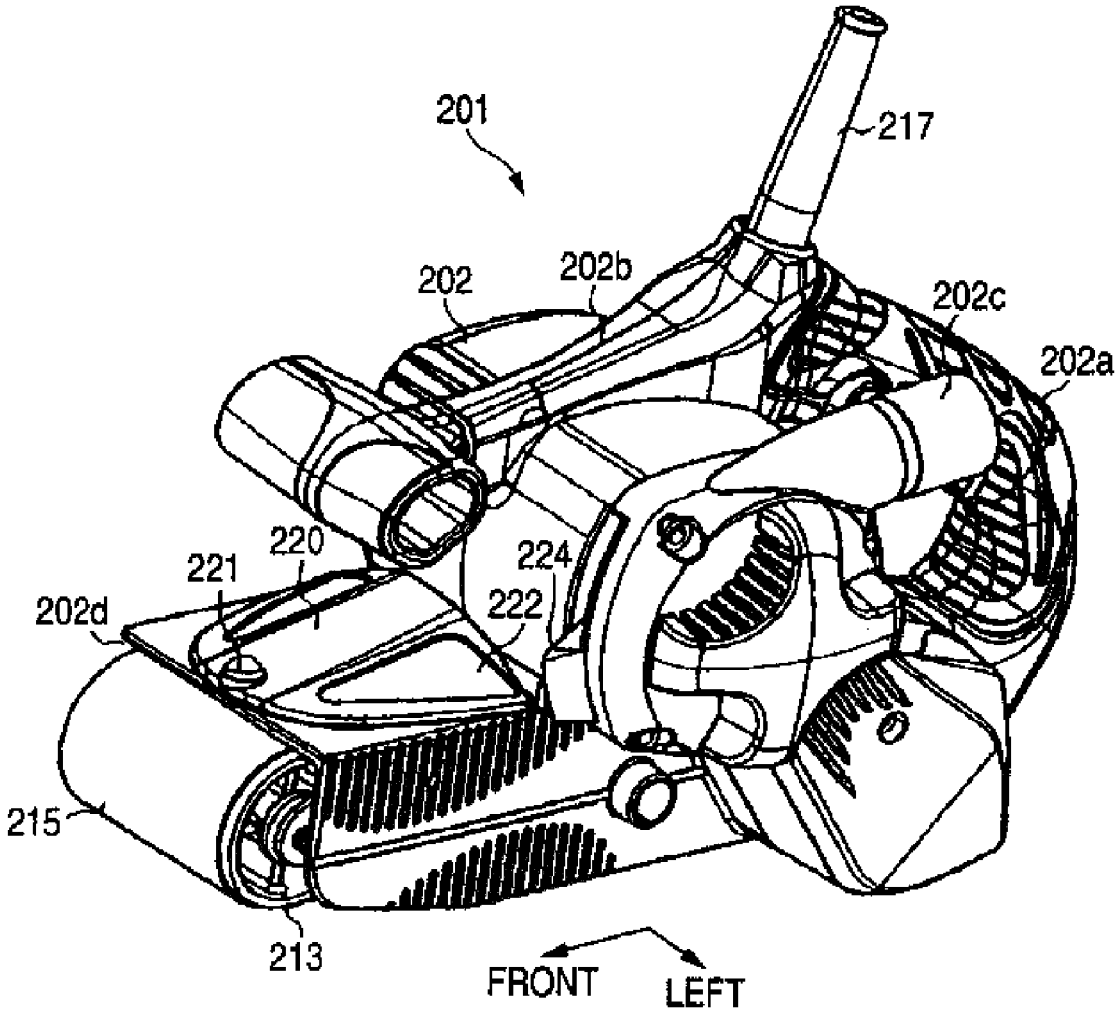
FIG. 1 is a perspective view of a portable belt grinder according to an embodiment 1 of the invention, when it is viewed from above.
Figure 2:
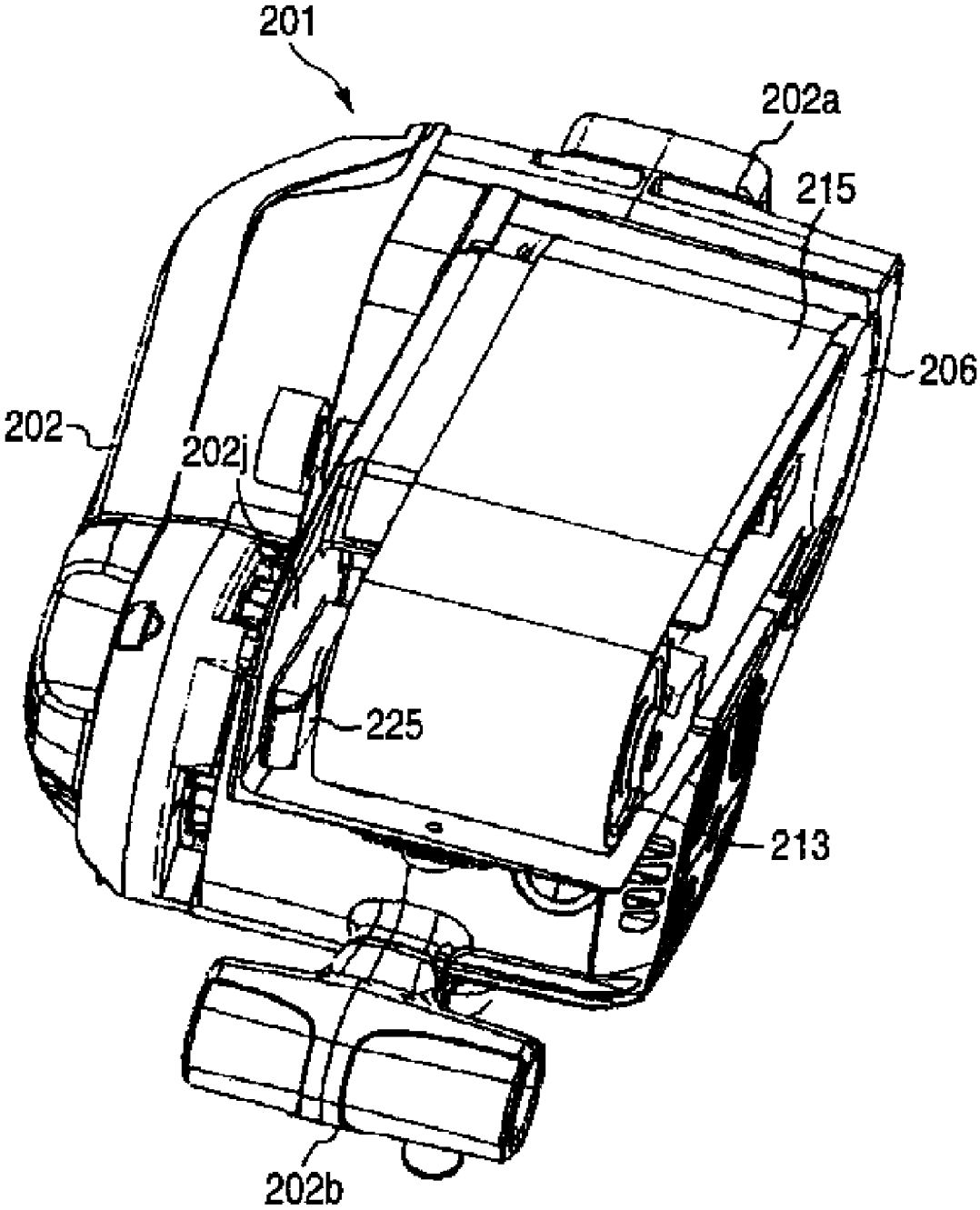
FIG. 2 is a perspective view of the portable belt grinder according to the embodiment 1 of the invention, when it is viewed from below.
Figure 3:
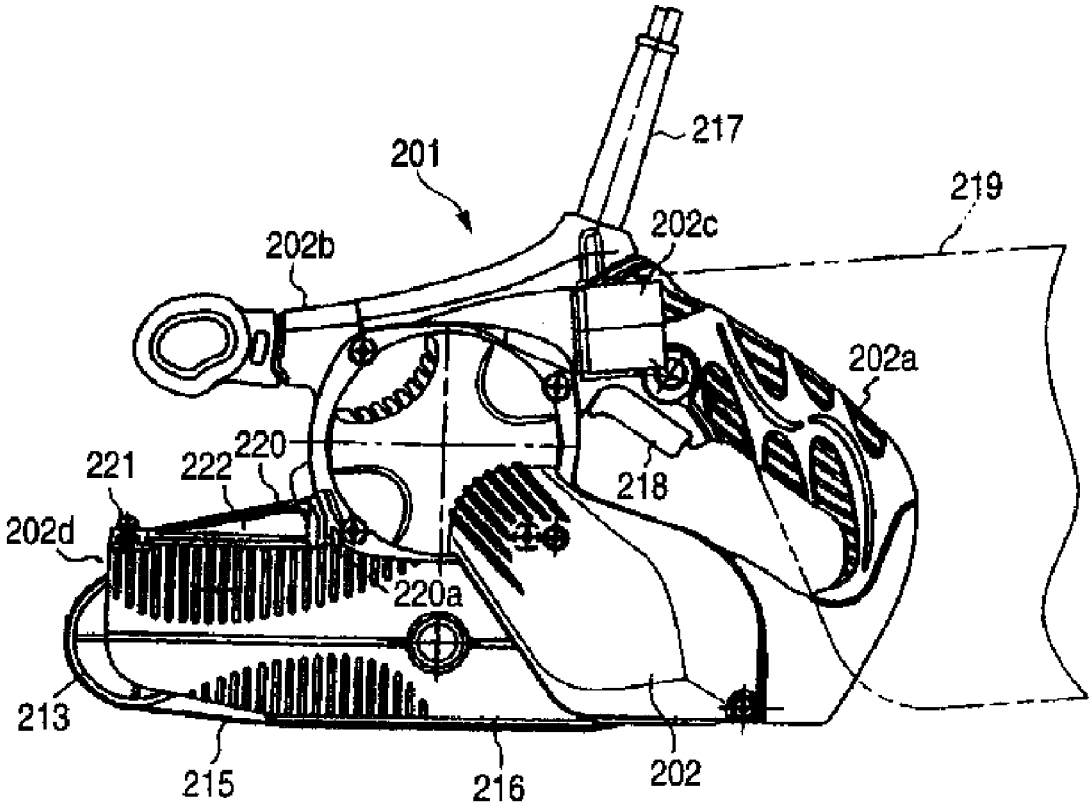
FIG. 3 is a left side view of the portable belt grinder according to an embodiment 1 of the invention.
Figure 4:
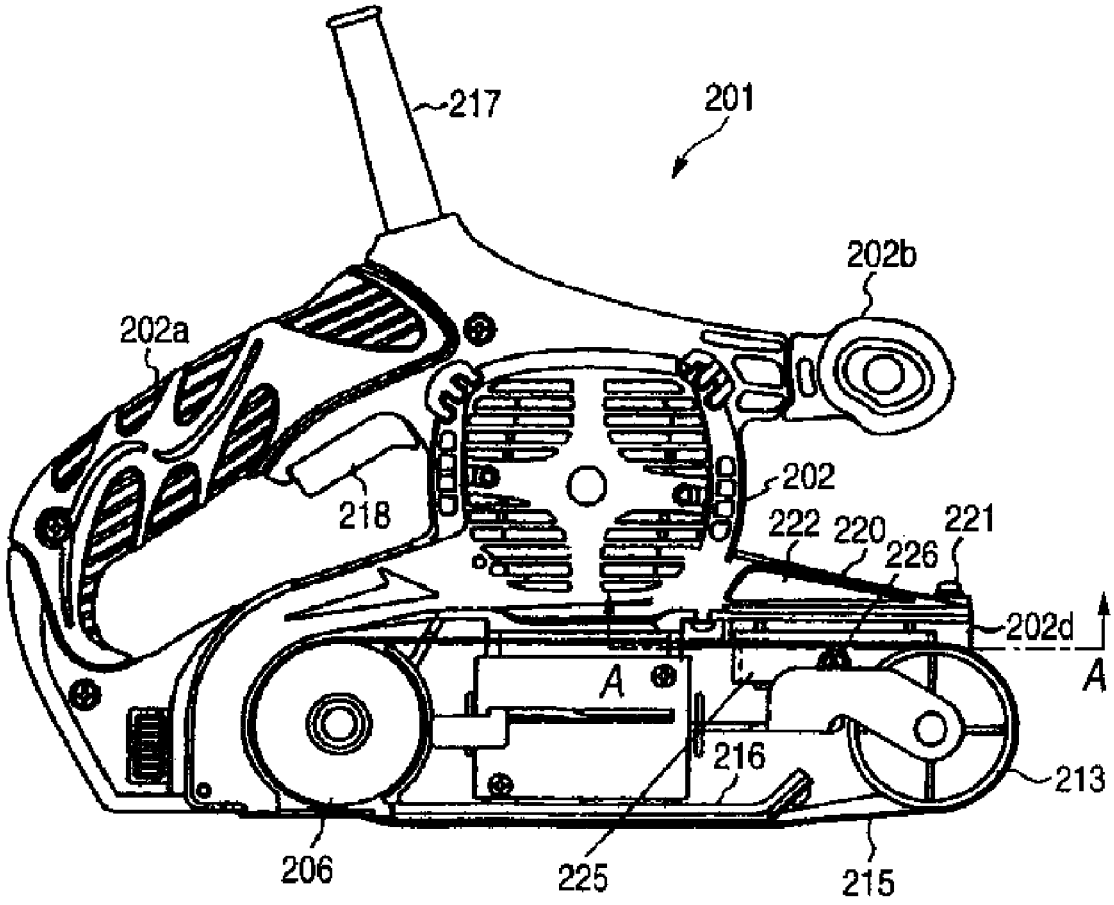
FIG. 4 is a right side view of the portable belt grinder according to an embodiment 1 of the invention.
Figure 5:
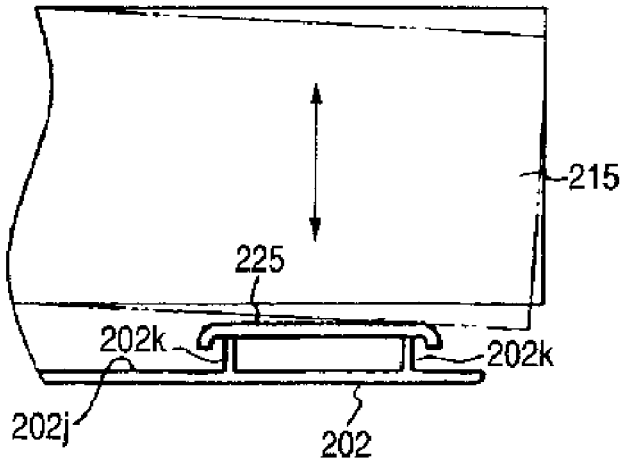
FIG. 5 is a section view taken along the A-A line shown in FIG. 4.
Figure 6:
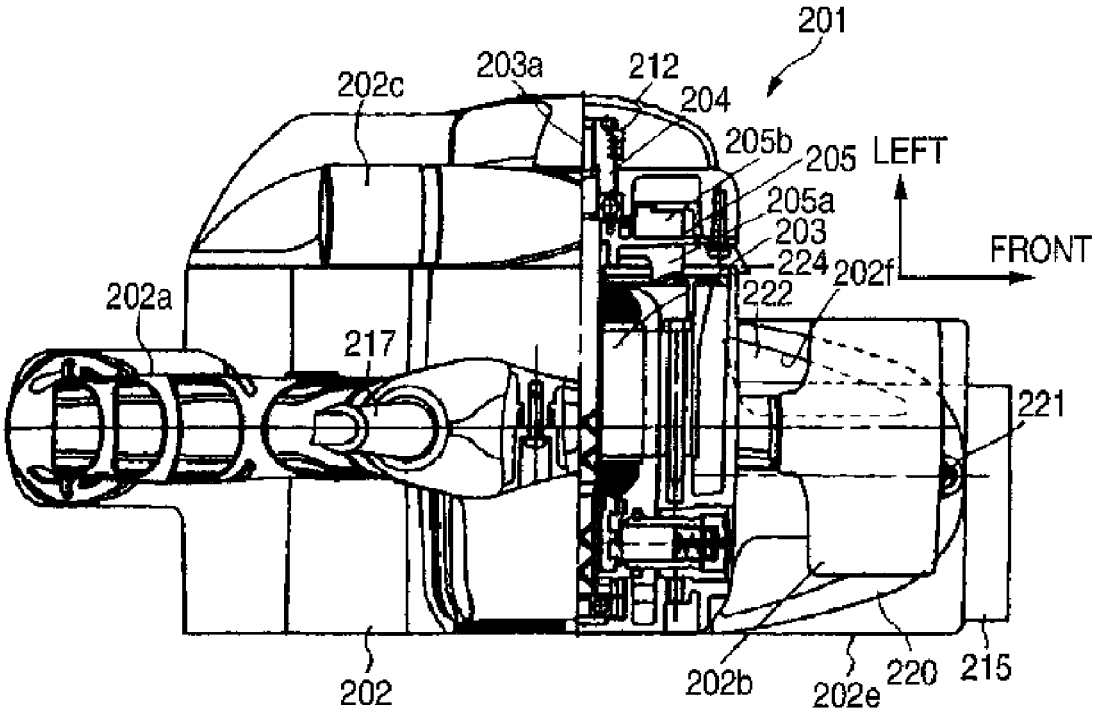
FIG. 6 is a half-cut plan view of the portable belt grinder according to the embodiment 1 of the invention.

FIG. 1 is a perspective view of a portable belt grinder according to an embodiment 1 of the invention, when it is viewed from above; FIG. 2 a perspective view of the portable belt grinder, when it is viewed from bottom; FIG. 3 is a left side view of the portable belt grinder; FIG. 4 is a right side view of the portable belt grinder; FIG. 5 is a section view taken along the A-A line shown in FIG. 4; FIG. 6 is a half-cut plan view of the portable belt grinder; and, FIG. 7 is a plan section view of the portable belt grinder.

In a portable belt grinder 201 according to the present embodiment, in the inside of a main body 202 thereof, there is stored an electric motor 203 serving as a drive source in such a manner that it lies horizontally. As shown in FIG. 6, to the end portion of the output shaft 203*a* of the electric motor 203 that extends horizontally, there is connected a pulley 204 which has a small diameter. Also, to the output shaft 203*a*, there is connected a cooling fan 205 as well. This cooling fan 205 serves also as a dust collecting fan. Specifically, on one surface of the cooling fan 205, there are provided two or more cooling blades 205*a* and, on the other surface thereof, there are provided two or more dust collecting blades 205*b*.

Figure 7:
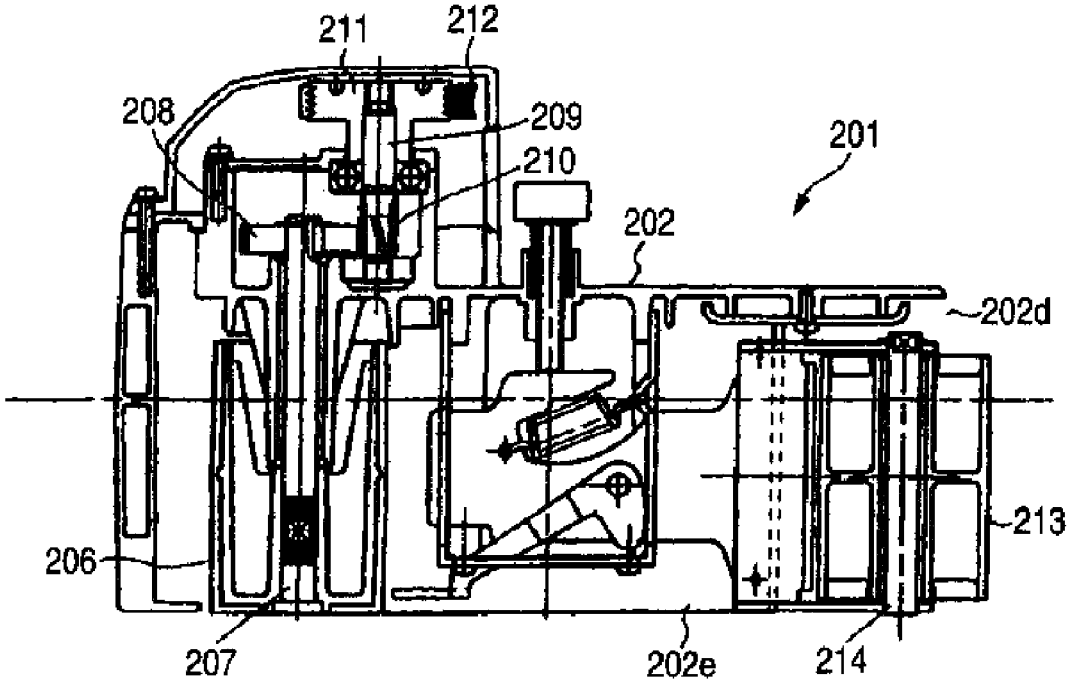
FIG. 7 is a plan section view of the portable belt grinder according to the embodiment 1 of the invention.

Also, as shown in FIG. 7, on the rear end portion (in FIG. 7, the left end portion) of the inside of the main body 202, there is rotatably supported a drum-shaped drive pulley 206 by a drive shaft 207. Here, the drive shaft 207 is arranged horizontally and is rotatably supported on the main body 202. To the drive shaft 207, there is connected the drive pulley 206 and, on one end of the drive shaft 207, there is mounted a gear 208. And, in front of the drive shaft 207 within the main body 202, there is arranged a rotatable intermediate shaft 209 in parallel to the drive shaft 207. In one end of the intermediate shaft 209, there is integrally formed a pinion 210 which is smaller in diameter than the gear 208; and, to the other end of the intermediate shaft 209, there is connected a pulley 211 which is larger in diameter than the pulley 204. And, the pinion 210 is meshingly engaged with the gear 208 and, between the two pulleys 204 and 211, there is wound an endless belt 212.

On the other hand, as shown in FIG. 7, on the front end portion of the main body 202, there is rotatably supported a drum-shaped idle pulley 213, which is the companion to the drive pulley 206, by a shaft 14 provided horizontally. Between the idle pulley 213 and drive pulley 206, there is wound an endless abrasive belt 215. The rotational movement of the abrasive belt 215 is guided by a guide plate 216 shown in FIG. 4.

Also, as shown in FIGS. 1, 3, and 4, the main body 202 includes a main handle 202*a* which is formed in the substantially central portion in the width direction of the rear end upper portion thereof; and, in front of the main handle 202*a*, there is almost horizontally extended a sub handle 202*b* which has a T-like shape when it is viewed from above. And, from the sub handle 202*b*, there is extended a power cord 217 which is used to supply electric power to the electric motor 203. Also, on the base end portion of the main handle 202*a*, there is provided a switch 218 which is used to turn on/off the power supply to the electric motor 203. On the left upper portion of the main body 202, there is provided a round-pipe-shaped dust collecting duct 202*c* which opens backwardly and extends horizontally; and, as shown in FIG. 3, on the end portion of the dust collecting duct 202*c*, there is mounted a dust collecting bag 219 which is shown by a chained line.

Here, the upper surface of the abrasive belt 215 is almost covered with the main body 202 and, in a portion of the front end of the main body 202, there is formed an exposure portion 202*d* in order to be able to use the curved surface of the idle pulley 213 for grinding. Also, in a portion of one side surface (in the present embodiment, the right end face portion) of the main body 202 existing closer to the abrasive belt 215, there is formed an open portion 202*e* (see FIG. 7) in order to be able to replace the abrasive belt 215.

And, in the portable belt grinder 201 according to the present embodiment, in a portion of the upper surface of the front end portion of the main body 202 that covers the abrasive belt 215, as shown in FIG. 6, there is formed a substantially triangular hole portion 202*f* which is used to visually confirm the side end edge of the abrasive belt 215 from above. This hole portion 202*f* is formed on the opposite side (on the left side) of the open portion 202*e* of the main body 202.

And, on the upper surface of the front end portion of the main body 202 in which the hole portion 202*f* is formed, there is mounted a cover member 220. That is, as shown in FIG. 3, a pawl portion 220*a* formed in one end portion of the cover member 220 is fitted into a recessed portion formed in the main body 202 and the other end of the cover member 220 is fastened by a screw 221, whereby the cover member 220 is mounted on the upper surface of the front end portion of the main body 202. And, the cover member 220 includes in a portion thereof a transparent cover 222 having the same shape as the hole portion 202*f* of the main body 202, while the hole portion 202*f* of the main body 202 is covered with the transparent cover 222. Therefore, the transparent cover 222 allows the operator to visually confirm the side end edge of the abrasive belt 215 from above through the hole portion 202*f* of the main body 202. According to the present embodiment, the transparent cover 222 has a slanting surface which is inclined obliquely.

Also, as shown in FIG. 6, the main body 202 includes an air passage 224 used to blow cooling air, which is used to cool the electric motor 203 by the cooling fan 205, onto the upper surface of the transparent cover 222.

By the way, as shown in FIGS. 2, 4 and 5, on the inner wall 202*j* of the main body 202 that exists on the opposite side to the open portion 202*e*, there are provided two rib-shaped projections 202*k* in such a manner that they are spaced from each other in the longitudinal direction of the main body 202 (in the moving direction of the abrasive belt 215); and, on these projections 202*k*, there is mounted a rectangular plate-shaped belt guide 225 by a screw 226 (see FIG. 4) in such a manner that it is substantially parallel to one side end edge of the abrasive belt 215. This belt guide 225 is made by press molding a material (such as an iron plate) higher in hardness than the main body 202. And, the belt guide 225 is used to receive one side end edge of the abrasive belt 215 when the abrasive belt 215 moves laterally as shown by a chain line in FIG. 5 and to thereby restrict the lateral movement (shift) of the abrasive belt 215.

Thus, according to the present embodiment, as shown in FIG. 5, the two end portions of the belt guide 225 in the belt moving direction are respectively bent in an R shape toward the inner wall 202*j* of the main body 202 by press molding.

When carrying out a grinding operation using the above-structured portable belt grinder 201, while gripping not only the main handle 202*a* provided in the rear portion of the main body 202 but also the sub handle 202*b* provided in the front portion of the main body 202, the operator operates the switch 218 to turn it on. As a result of this, the electric motor 203 is driven and thus the output shaft 203*a* thereof is rotated. The rotation of the output shaft 203*a* is transmitted to the intermediate shaft 209 while it is reduced through the pulley 204, belt 212 and pulley 211. And, the rotation of the intermediate shaft 209 is transmitted to the drive shaft 207 while it is reduced through the pinion 210 and gear 208, so that the drive shaft 207 and drive pulley 206 connected thereto are respectively driven and rotated at a given speed.

As the drive pulley 206 is driven and rotated in the above-mentioned manner, the abrasive belt 215 wound between the drive pulley 206 and idle pulley 213 is rotated on the lower surface of the guide plate 216; and, when the abrasive belt 215 is pressed against the member to be ground (not shown) such as lumber, the surface of the member to be ground can be ground by the abrasive belt 215.

Also, the cooling fan 205, which is connected to the output shaft 203*a* of the electric motor 203, is rotated; and, the electric motor 203 is cooled by the cooling air that is induced by the rotational movements of the cooling blades 205*a* of the cooling fan 205. And, the rotational movements of the dust collecting blades 205*b* of the cooling fan 205 generate a negative pressure within the main body 202, whereby cut powder produced due to the grinding of the member to be ground is sucked into the main body 202. The cut powder, which has been sucked into the main body 202, is discharged from the dust collecting duct 202*c* externally of the main body 202 and is then collected into the dust collecting bag 219.

In the portable belt grinder 201 according to the present embodiment, in the portion of the main body 202 that exists in the vicinity of the abrasive belt 215, there is formed the hole portion 202*f* for visually confirming the side end edge of the abrasive belt 215 from above. Owing to this, in the grinding operation, without looking into the open portion 202*e* of the side surface of the main body 202 or the exposure portion 202*d* of the front end of the main body 202, it is possible to confirm easily which position of the member to be ground is currently being ground, which makes it possible to enhance the efficiency of the grinding operation.

Also, according the present embodiment, since the hole portion 202*f* of the main body 202 is covered with the transparent cover 222, in the grinding operation, the hands of the operator can be prevented from touching the abrasive belt 215, which can ensure the safety of the operator.

Further, according to the present embodiment, as shown in FIG. 3, since there is formed the air passage 224 used to blow cooling air, which is used to cool the electric motor 203 by the cooling fan 205, onto the upper surface of the transparent cover 222, in the grinding operation, cut powder, which has flown up externally of the main body 202, can be prevented from sticking to the upper surface portion of the transparent cover 222, which makes it possible to prevent the lowered visual confirmation performance due to the sticking of the cut powder to the transparent cover 222. Also, since, as described above, the transparent cover 222 slants obliquely, cut powder having dropped down onto the transparent cover 222 slips off the transparent cover 222 along the slanting surface thereof but does not remain on the upper surface of the transparent cover 222, thereby preventing the visual confirmation performance from being impaired by the cut powder.

Moreover, since the cover member 220 can be easily mounted onto and removed from the main body 202, as the need arises, the cover member 220 can be removed and the cut powder or the like sticking to the inner surface of the transparent cover 222 can be wiped off.

Also, according to the present embodiment, since the belt guide 225 is mounted on the inner wall 202*j* of the main body 202 existing on the opposite to the open portion 202*e*, even when the abrasive belt 215 moves laterally as shown by a chain line in FIG. 5, the side end edge of the abrasive belt 215 is received by the belt guide 225 to thereby be able to restrict the lateral movement (shift) of the abrasive belt 215. In addition, as described above, since the two end portions of the belt guide 225 in the belt moving direction are bent in an R shape toward the inner wall 202*j* of the main body 202 (see FIG. 5), even when the abrasive belt 215 moves laterally and thus the side end edge thereof touches the belt guide 225, the collision of the abrasive belt 215 with the two end portions of the belt guide 225 in the longitudinal direction thereof can be avoided, thereby being able to prevent the abrasive belt 215 from being broken due to such possible collision. And, since the touch of the abrasive belt 215 with the belt guide 225 can be confirmed from the hole portion 202*f* of the main body 202 through the transparent cover 222, by advancing the grinding operation while preventing these two element from touching each other, the durability of the abrasive belt 215 can be enhanced and thus the life of the abrasive belt 215 can be extended.

<Embodiment 2>

Next, description will be given below of an embodiment 2 according to the invention with reference to FIGS. 8 to 12.

Figure 8:
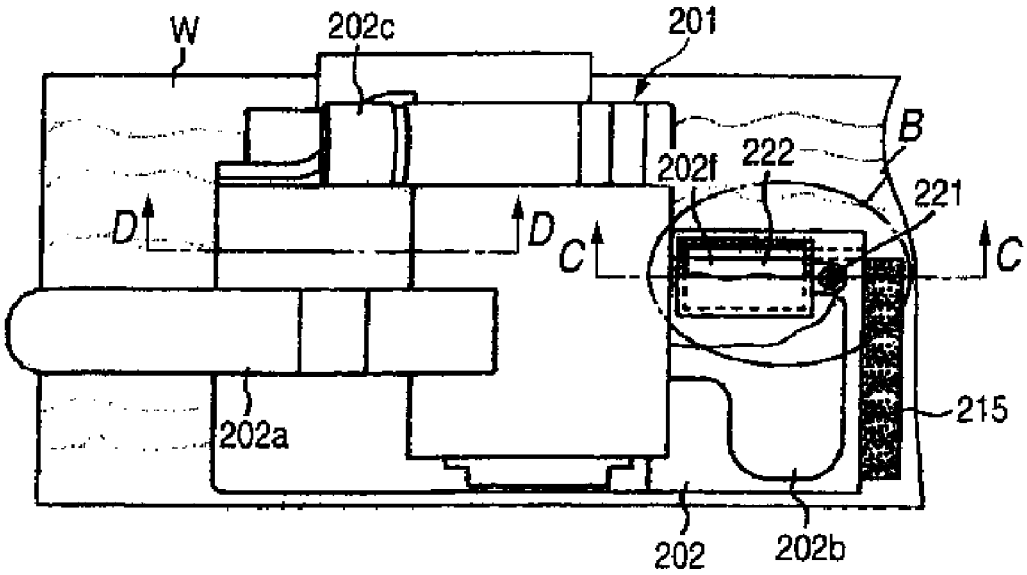
FIG. 8 is a broken section view of a portable belt grinder according to an embodiment 2 of the invention.
Figure 9:
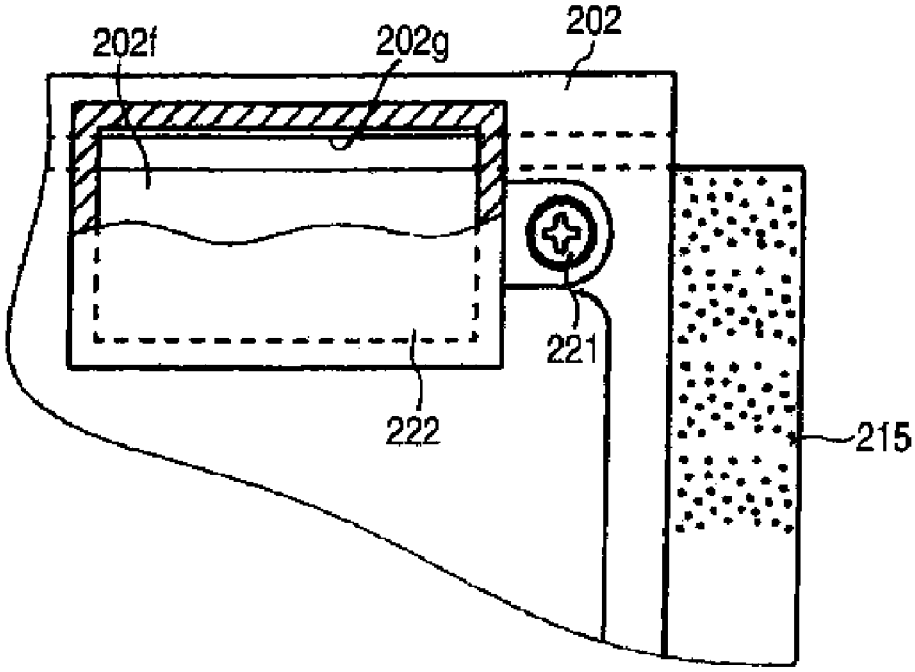
FIG. 9 is an enlarged detailed view of the B portion shown in FIG. 8.
Figure 10:
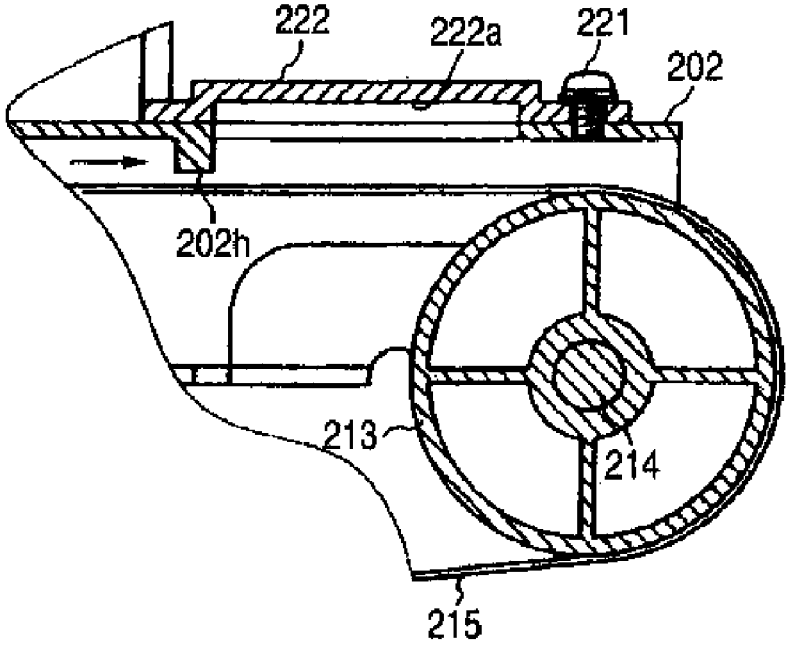
FIG. 10 is a section view taken along the C-C line shown in FIG. 8.
Figure 11:
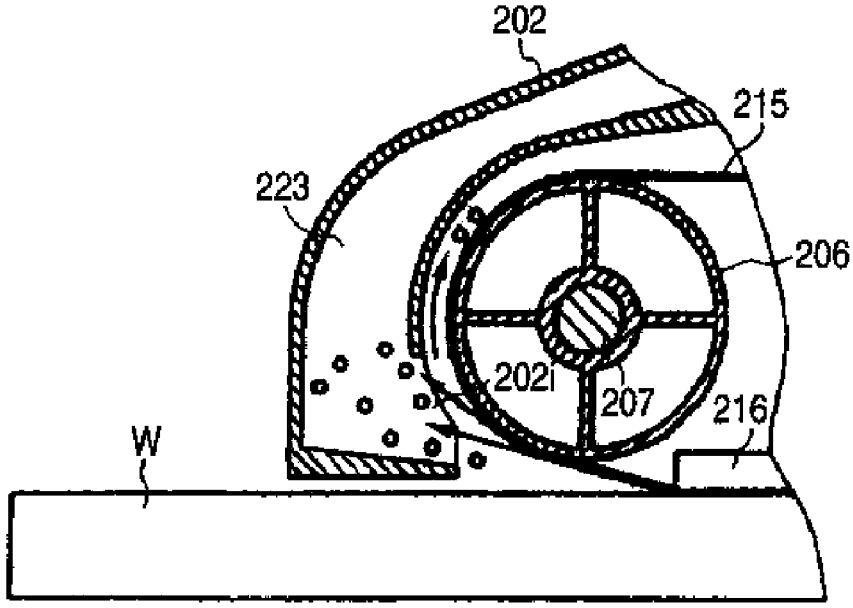
FIG. 11 is a section view taken along the D-D line shown in FIG. 8.

FIG. 8 is a broken plan view of a portable belt grinder according to the present embodiment, FIG. 9 is an enlarged detailed view of the B portion shown in FIG. 8, FIG. 10 is a section view taken along the C-C line shown in FIG. 8, FIG. 11 is a section view taken along the D-D line shown in FIG. 8, and FIG. 9 is a broken plan view of the present portable belt grinder, showing the structure of an air passage formed therein. In these figures, the same elements as shown in FIGS. 1 to 7 are given the same reference characters respectively.

In a portable belt grinder 201 according to the present embodiment, as shown in FIGS. 8 to 10, the main body 202 includes, in a portion of the upper surface of the front end portion of the main body 202 that covers the abrasive belt 215, a rectangular-shaped hole portion 202*f* which is used to visually confirm the side end edge of the abrasive belt 215 and the inner wall portion 202*g* (see FIG. 9) of the main body 202 extending parallel to this side end edge from above. And, the hole portion 202*f* is formed on the opposite side (on the left side) to the open portion 202*e* of the main body 202.

And, on the upper surface of the front end portion of the main body 202 where the hole portion 202*f* is formed, there is mounted a rectangular-shaped transparent cover 222 by a screw 221, while the hole portion 202*f* of the main body 202 is covered with the transparent cover 222. Therefore, during the grinding operation, the transparent cover 222 allows the operator to visually confirm the side end edge of the abrasive belt 215 and the inner wall portion 222*g* of the main body 202 from above.

Here, the inner wall 222*a* of the transparent cover 222, as shown in FIG. 10, is set at a position higher than the upper surface of the main body 202 (at a position more distant from the abrasive belt 215); and, on a portion of the main body 202 that exists in the vicinity of the hole portion 222*f* (that is, on the lower surface of the upper portion of the main body 202 that exists on the opposite side of the rotation direction of the abrasive belt 215), there is projectingly provided a project portion 202*h* which extends downwardly almost at right angles to the abrasive belt 215.

Also, as shown in FIG. 11, in a portion of the rear end lower portion of the main body 202 that exists in the vicinity of the drive pulley 206, there is opened up a cut powder discharge opening 202*i*. Cut powder, which has been produced due to the grinding operation, is discharged from the cut powder discharge opening 202*i*, is then sent through a cut powder discharge passage 223 to a dust collecting duct 202*c* shown in FIG. 8, and is finally collected into a dust collecting bag (not shown) which is mounted on the dust collecting duct 202*c*.

Figure 12:
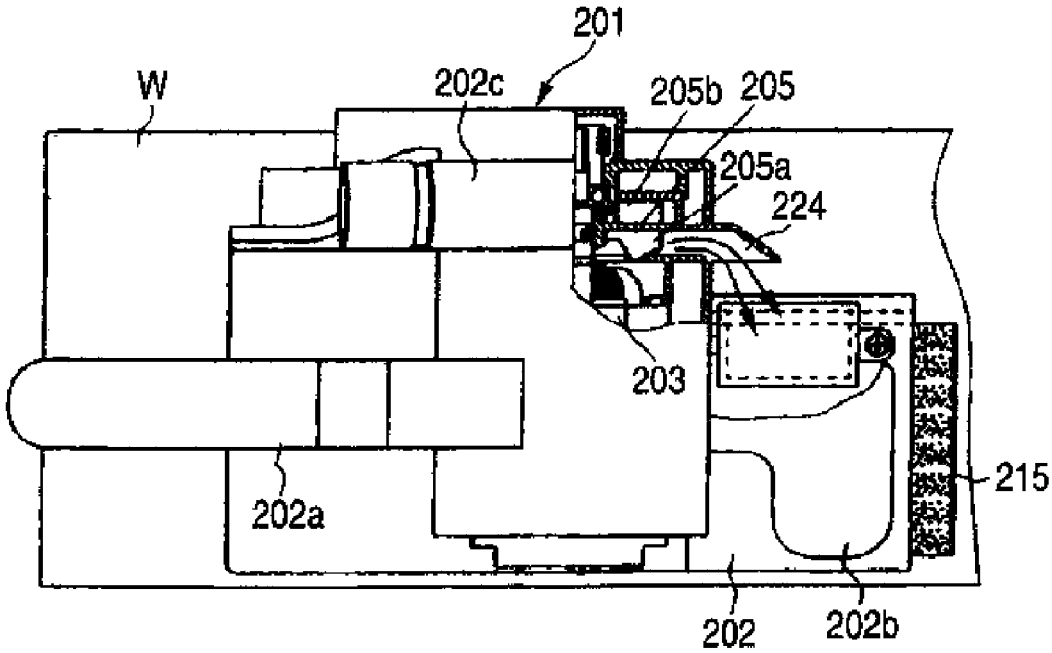
FIG. 12 is a broken plan view of the portable belt grinder according to the embodiment 2 of the invention, showing the structure of an air passage formed therein.
Figure 13:
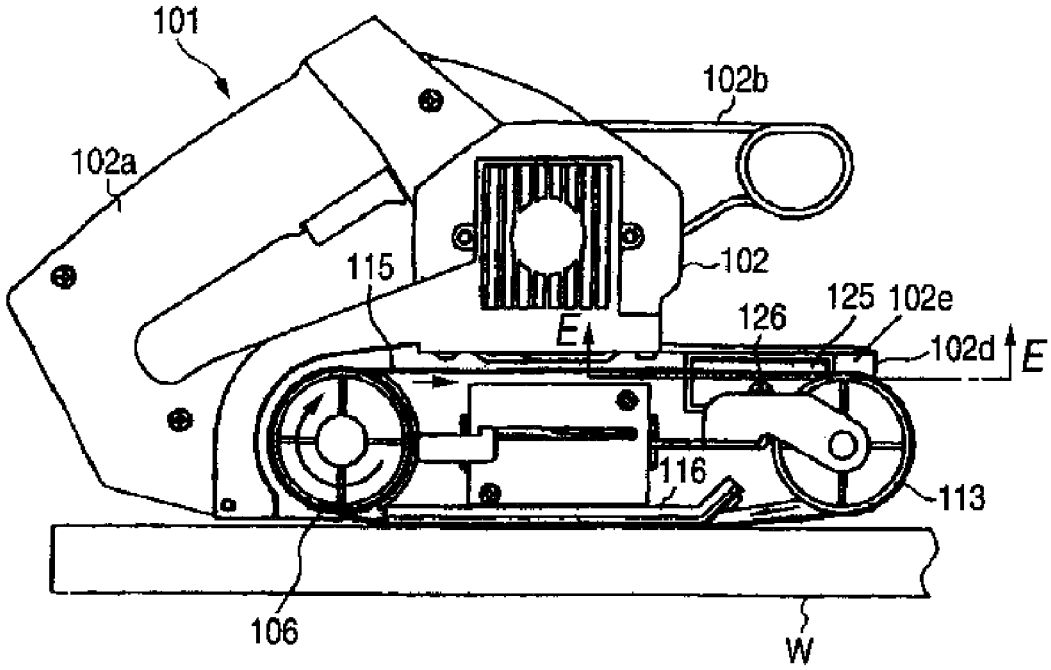
FIG. 13 is a right side view of a conventional portable belt grinder.
Figure 14:
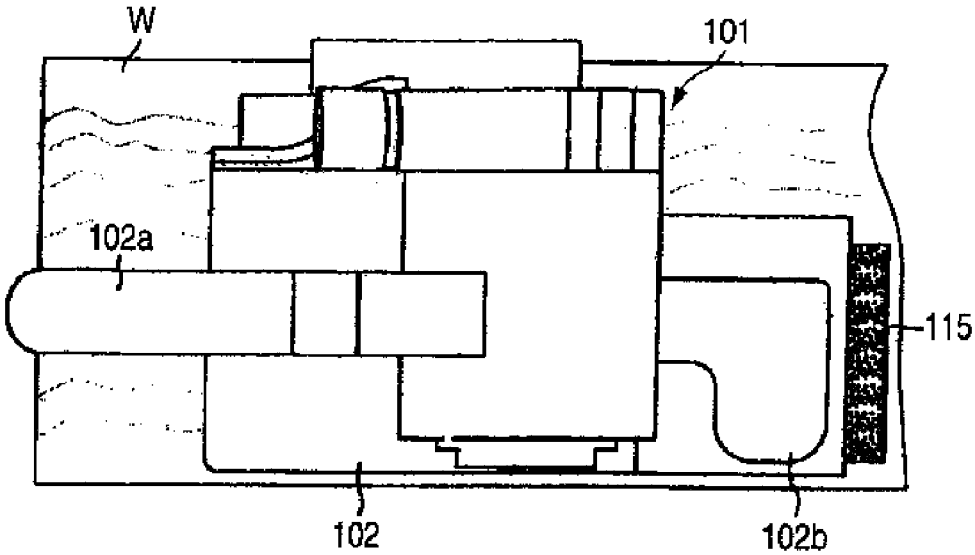
FIG. 14 is a plan view of the conventional portable belt grinder.
Figure 15:
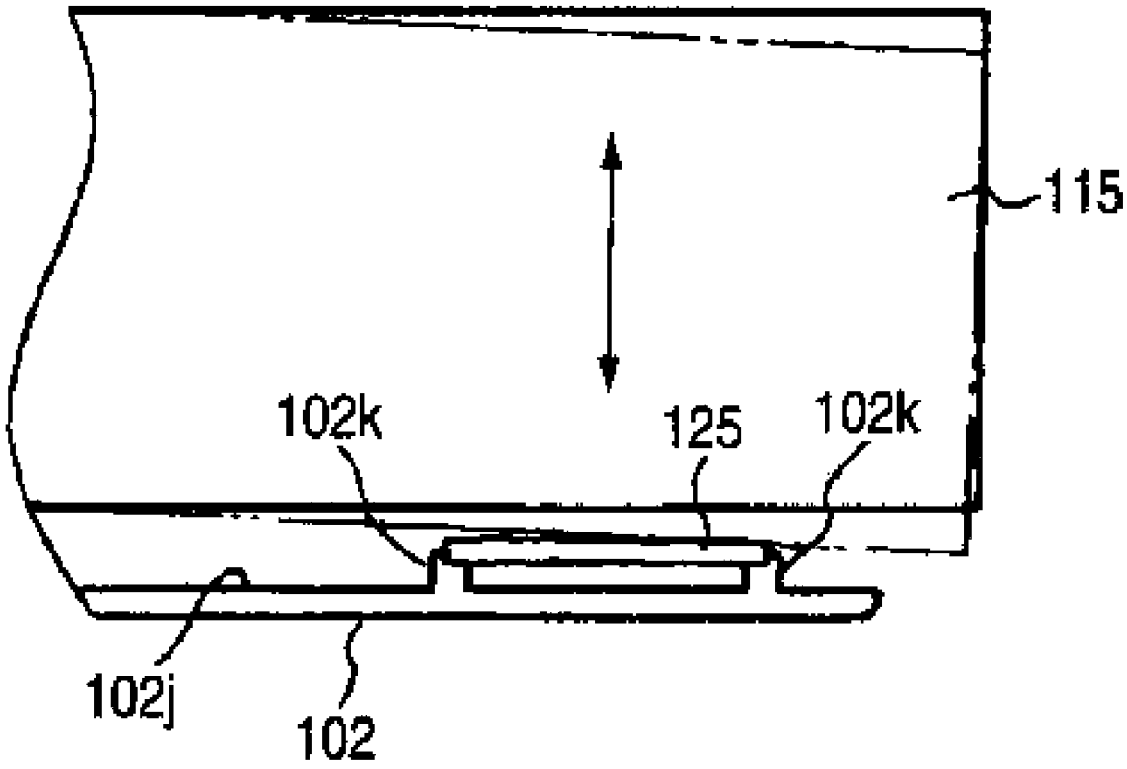
FIG. 15 is a section view taken along the E-E line shown in FIG. 13.

Further, in the portable belt grinder 201 according to the present embodiment as well, as shown in FIG. 12, to the output shaft 203*a* of the electric motor 203, there is connected a cooling fan 205; and, on one surface of the cooling fan 205, there are provided two or more cooling blades 205*a* and, on the other surface thereof, there are provided two or more dust collecting blades 205*b*. However, according to the present embodiment, there is formed an air passage 224 used to blow cooling air, which is used to cool the electric motor 203 by the cooling fan 205, onto the upper surface portion of the transparent cover 222.

In the portable belt grinder 201 according to the present embodiment as well, since, in the portion of the main body 202 that exists in the vicinity of the abrasive belt 215, there is formed the hole portion 202*f* which is used to visually confirm the side end edge of the abrasive belt 215 from above, in the grinding operation, without looking into the open portion

202*e* of the side surface of the main body 202 or the exposure portion 202*d* of the front end of the main body 202, the operator can easily confirm which position of the member to be ground W is currently being ground, which makes it possible to enhance the efficiency of the grinding operation.

Also, according to the present embodiment, since it is possible to visually confirm not only the side end edge of the abrasive belt 215 but also the inner wall portion 202*g* of the main body 202 extending parallel to the side end edge from the hole portion 202*f*, touch between the abrasive belt 215 and the inner wall portion 202*g* of the main body 202, if any, can be confirmed. Thus, by advancing the grinding operation while preventing these two elements from touching each other, the durability of the abrasive belt 215 can be enhanced and thus the life thereof can be extended.

Further, since the hole portion 202*f* of the main body 202 is covered with the transparent cover 222, in the grinding operation, the hands of the operator can be prevented from touching the abrasive belt 215, which can ensure the safety of the operator.

Also, according to the present embodiment, as shown in FIG. 10, not only because the inner wall 222*a* of the transparent cover 222 is set at a position higher than the upper surface of the main body 202 but also because, on a portion of the main body 202 that exists closer to the hole portion 202*f*, there is provided the projection portion 202*h* which extends substantially at right angles to the abrasive belt 215, of the cut powder that has been produced due to the grinding of the member to be ground W, the cut powder not moving toward the cut powder discharge opening 202*i* shown in FIG. 8 but flying around along the abrasive belt 215 is caused to collide with the projection portion 202*h* and drop down there. This can prevent the cut powder from sticking to the inner wall 222*a* of the transparent cover 222 and thus can prevent the visual confirming performance from being worsened due to the cut powder sticking to the inner wall 222*a*.

Further, according to the present embodiment, as shown in FIG. 12, since there is formed the air passage 224 used to blow cooling air, which is used to cool the electric motor 203 by the cooling fan 205, onto the upper surface portion of the transparent cover 222, in the grinding operation, the cut powder flying up externally of the main body 202 can be prevented from sticking to the upper surface portion of the transparent cover 222, thereby being able to prevent the visual confirmation performance from being worsened due to the sticking of the cut powder to the transparent cover 222.

The invention claimed is:

1. A portable belt grinder comprising:

a main body;

a motor disposed in the main body and including a cooling fan rotatable with a rotor of a motor;

a drive pulley and an idle pulley which are disposed in a lower part of the main body, the drive pulley being driven to rotate by the motor;

an endless abrasive belt wound between the drive pulley and the idle pulley, a hole being provided on the main body so that a side edge of the abrasive belt can be seen through the hole;

a transparent cover provided on an upper surface of the main body for covering the hole; and an air passage provided in the main body for blowing an air generated by the cooling fan onto the upper surface of the transparent cover.

2. The portable belt grinder as set forth in claim 1, further comprising a belt guide for restricting lateral movement of the endless abrasive belt.

3. The portable belt grinder as set forth in claim 2, wherein end portions of the belt guide are respectively curved toward an inner wall of the main body.

4. The portable belt grinder as set forth in claim 1, wherein one side of the main body adjacent to the abrasive belt is formed open and the hole is formed on the other side of the main body.

* * * * *